US006226951B1

(12) United States Patent
Azar

(10) Patent No.: US 6,226,951 B1
(45) **Date of Patent: *May 8, 2001**

(54) CONCRETE BUILDING BLOCKS

(75) Inventor: Tony J. Azar, Tecumseh (CA)

(73) Assignee: Azar Holdings Ltd. (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/974,726

(22) Filed: Nov. 19, 1997

Related U.S. Application Data

(63) Continuation-in-part of application No. 08/761,983, filed on Dec. 11, 1996, now abandoned.

(51) Int. Cl.[7] ..... E04C 1/00

(52) U.S. Cl. ..... 52/604; 52/421; 52/426; 52/591.1; 52/592.1; 52/592.6; 52/606

(58) Field of Search ..... 52/421, 426, 591.1, 52/592.6, 604, 606, 592.1, 596, 302.4, 144, 315, 316

(56) References Cited

U.S. PATENT DOCUMENTS

| | | | | |
|---|---|---|---|---|
| 1,630,698 | | 5/1927 | Florey . | |
| 1,884,319 | * | 10/1932 | Smith | 52/421 X |
| 1,988,492 | | 1/1935 | Henderson . | |
| 2,294,776 | * | 9/1942 | Freeman | 52/591.1 |
| 2,684,589 | | 7/1954 | Perreton . | |
| 2,749,739 | * | 6/1956 | Zagray | 52/592.6 X |
| 3,416,276 | | 12/1968 | Caputo et al. . | |
| 4,075,808 | | 2/1978 | Pearlman . | |
| 4,439,967 | * | 4/1984 | Dielenberg | 52/421 X |
| 4,597,236 | | 7/1986 | Braxton . | |
| 4,993,206 | * | 2/1991 | Pardo | 52/302.4 X |
| 5,024,035 | * | 6/1991 | Hansen et al. | 52/591.1 |
| 5,230,194 | | 7/1993 | McClure . | |
| 5,598,679 | | 2/1997 | Orton et al. . | |

FOREIGN PATENT DOCUMENTS

| | | |
|---|---|---|
| 500292 | 12/1976 | (AU) . |
| 581793 | 5/1988 | (AU) . |
| 658200 | 3/1993 | (AU) . |
| 648235 | 4/1994 | (AU) . |
| 2143234 | 7/1996 | (CA) . |
| 1 659 120 | 12/1971 | (DE) . |
| 0 019 900 | 12/1980 | (EP) . |
| 654057 | 6/1951 | (GB) . |
| 693536 | 7/1953 | (GB) . |
| 118691 | 9/1958 | (GB) . |
| 2 037 841 | 7/1980 | (GB) . |
| 2 060 026 | 4/1981 | (GB) . |
| 2 088 433 | 6/1982 | (GB) . |
| 2 197 358 | 5/1988 | (GB) . |
| 196092 | 7/1984 | (NZ) . |

* cited by examiner

*Primary Examiner*—Christopher Kent
(74) *Attorney, Agent, or Firm*—Gerald E. Hespos; Anthony J. Casella; Michael J. Porco

(57) ABSTRACT

The building block is provided. The block is substantially rectangular and has opposed first and second ends. First and second substantially congruent rectangular panels extend between the ends and are joined together by at least one web. Each panel has vertical end edges that are notched to fit with the end edges of another such block. The notches are disposed selectively on inside or outside corners of the respective blocks to enable adjacent blocks to interfit in a vertical joint.

8 Claims, 6 Drawing Sheets

CONCRETE BUILDING BLOCKS

This application is a continuation-in-part of application Ser. No. 08/761,983, filed on Dec. 11, 1996, now abandoned.

FIELD OF THE INVENTION

The present invention relates to the field of building blocks, in particular concrete building blocks. The present invention provides a novel dry stack building block, in a stretcher embodiment, and a corner embodiment.

BACKGROUND OF THE INVENTION

Building blocks, in particular concrete building blocks, are used extensively in the construction of walls, both below grade in the case of foundation walls, and above grade, in the case of structural walls. Concrete blocks generally have hollow cores, planar, rectangular faces, and rectangular ends and upper and lower surfaces. They are ordinarily stacked in a stretching bond pattern, with mortar between each course of blocks, and between each block in a course. As required, rebar may be inserted in the cores of the blocks, after stacking, and the cores may be filled with concrete. There have, moreover, been attempts to develop concrete blocks with dry stacking capability. For instance, in U.S. Pat. No. 5,230,194 to McClure, a block is described with front and back faces that are offset slightly from the upper and lower surfaces, and the ends of the block. This feature permits the blocks to be dry stacked and interlocked. However, no satisfactory means for forming a corner is disclosed by McClure, who instead discloses an L-shaped corner suitable for one-way, right or left usage.

In U.S. Pat. No. 4,597,236 (Braxton), a dry-stack block is disclosed that relies on the use of spines insertable between blocks in a stacked wall. Braxton discloses corners constructed from blocks that are smaller than the remaining blocks in this system, and which do not permit the use of a stretcher bond pattern of block laying.

In view of the foregoing, the object of the present invention is to provide a novel dry stacking, interlocking concrete block that has a stretcher and corner embodiment of similar overall dimensions. Such a block can be utilized to dry stack a wall, with such corners as are desired by the builder rather than dictated by the block, in the traditional strong stretcher bond pattern of block laying.

A further object of the present invention is to provide a dry stack block that is provided with a surface that is grooved to permit fast and efficient drainage from the faces thereof.

In a broad aspect, then, the present invention relates to a building block comprising two substantially congruent rectangular panels joined together by at least one web extending transverse thereto, said panels having vertical end edges that are notched to interfit with the end edges of the panels of adjacent said blocks in a vertical joint therewith.

BRIEF DESCRIPTION OF THE DRAWINGS

In drawings that illustrate the present invention by way of example.

DETAILED DESCRIPTION

Figure 1:
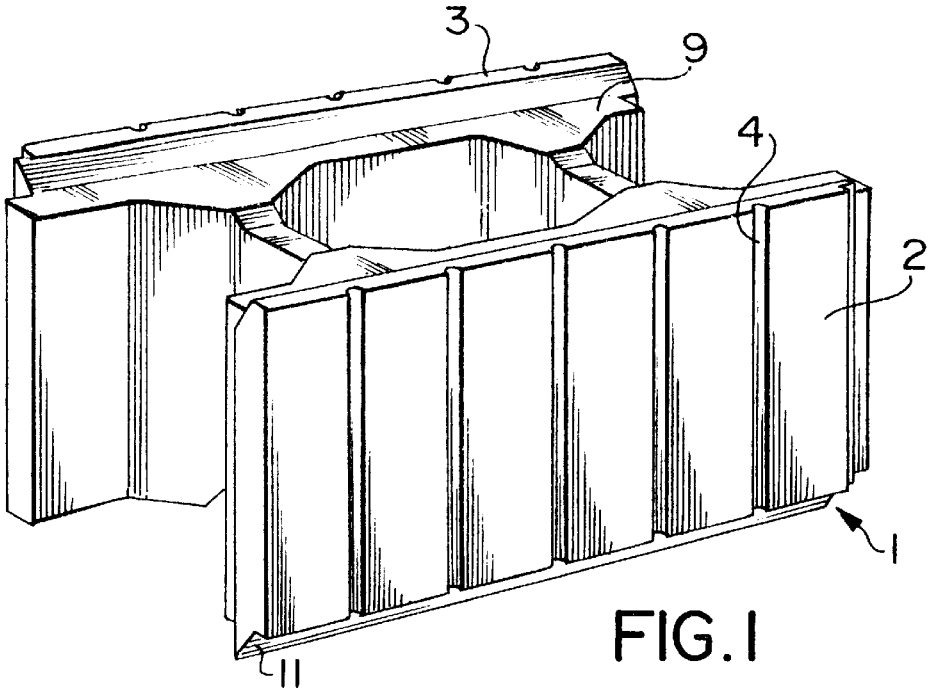
FIG. 1 is a perspective view from the underside, of a stretcher block according to the present invention.

Referring now to FIGS. 1–6, the basic concrete stretcher block 1 according to the present invention is illustrated. It comprises a front face 2, and rear face 3, which are substantially identical and interchangeable. The faces 2,3 are provided on their surfaces with grooves 4 that extend vertically, and serve to channel water from the face of the blocks. The presence of grooves 4 is especially important for sub-grade applications, in which fill has been compacted against the exposed face of the blocks.

Figure 5:
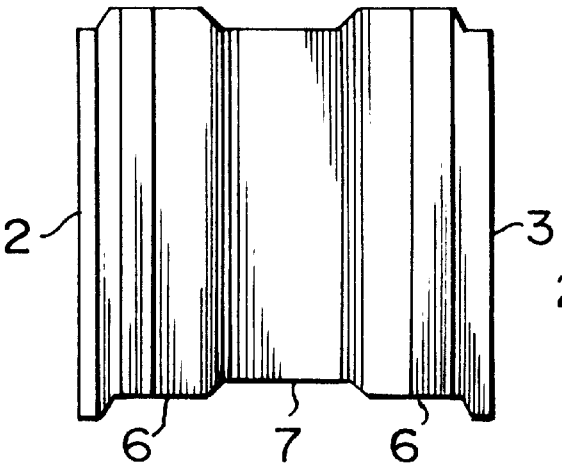
FIG. 5 is one end view of the block shown in FIG. 1.
Figure 6:
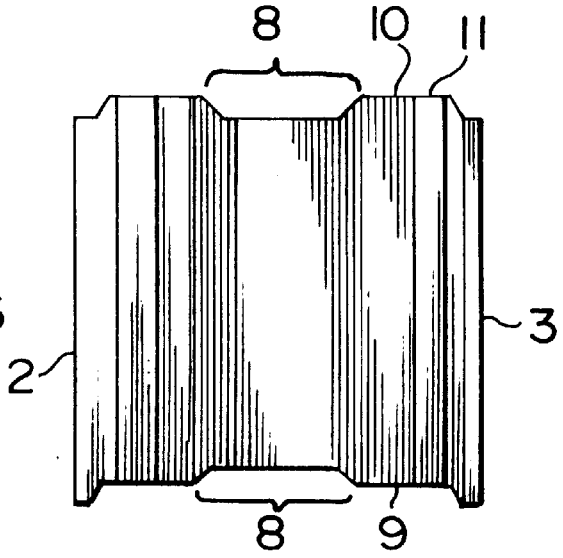
FIG. 6 is the other end view of the block shown in FIG. 1.
Figure 7:
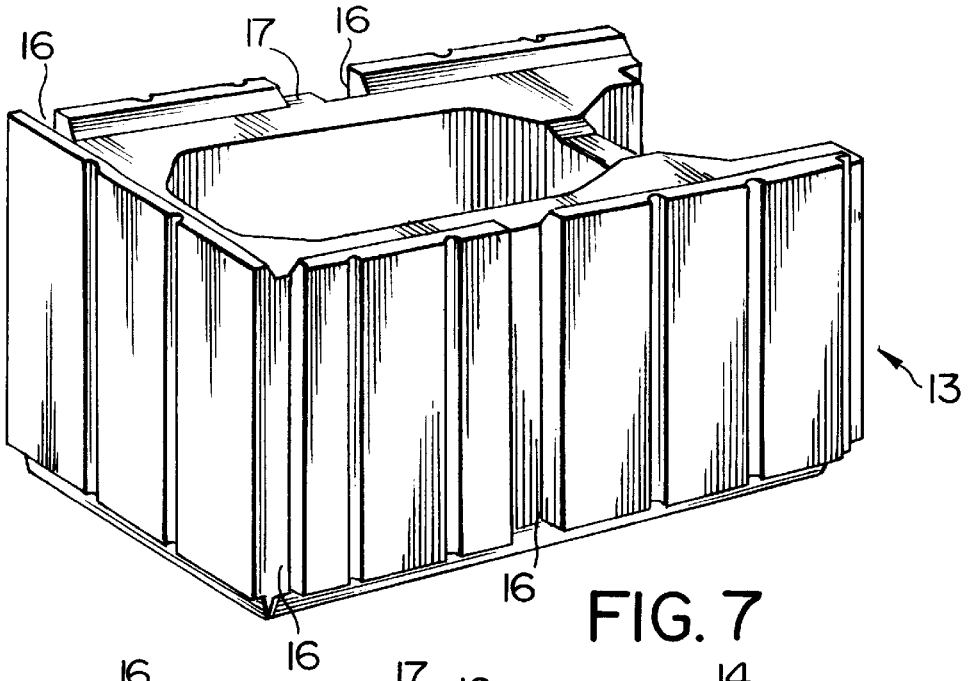
FIG. 7 is a perspective view, from the underside, of a corner block according to the present invention.
Figure 8:
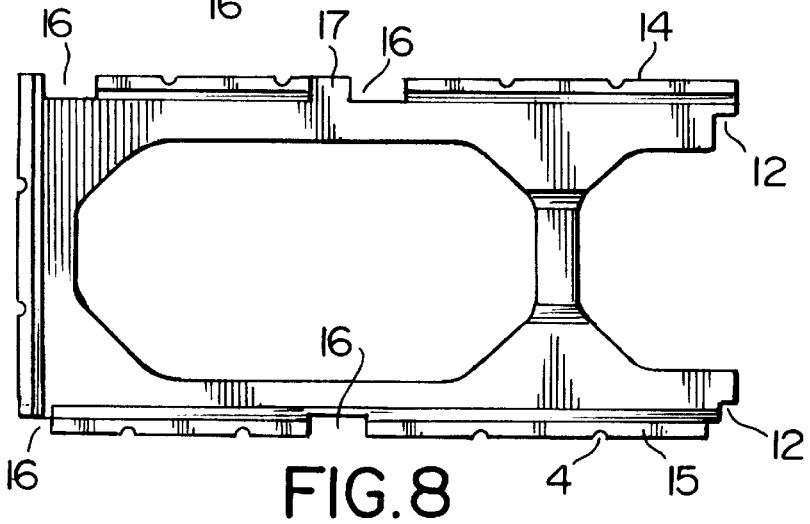
FIG. 8 is an underside view of the block shown in FIG. 7.
Figure 9:
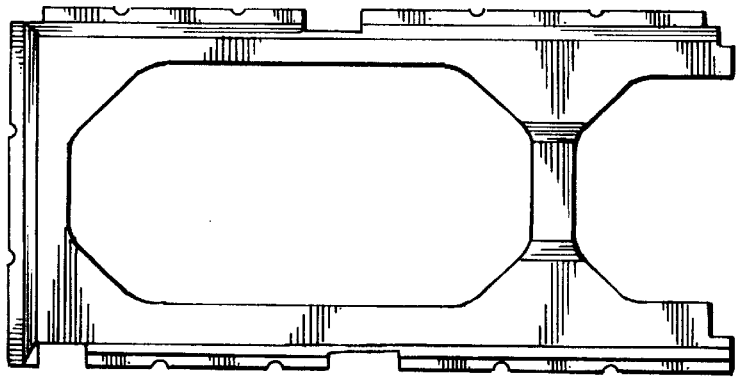
FIG. 9 is a top view of the block shown in FIG. 7.
Figure 10:
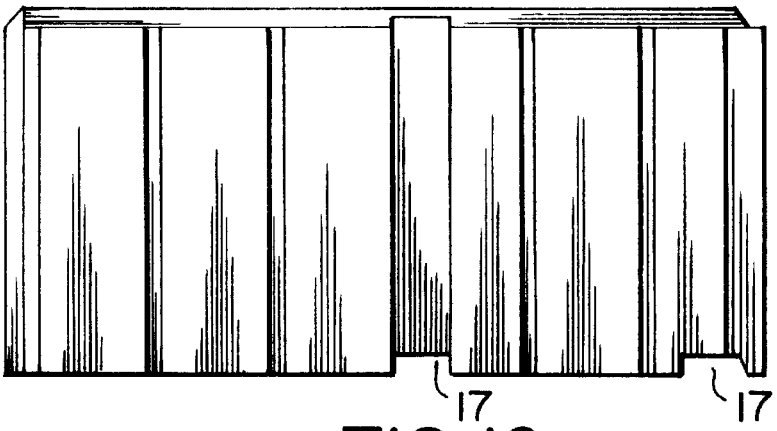
FIG. 10 is a view of one side of the block shown in FIG. 7.
Figure 11:
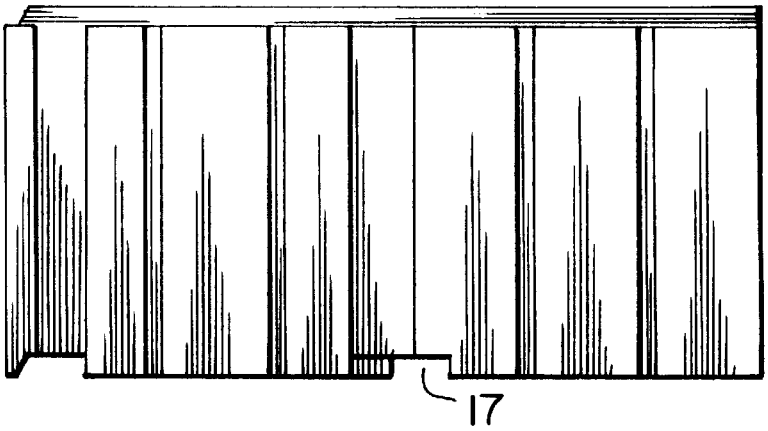
FIG. 11 is a view of the other side of the block shown in FIG. 7.
Figure 12:
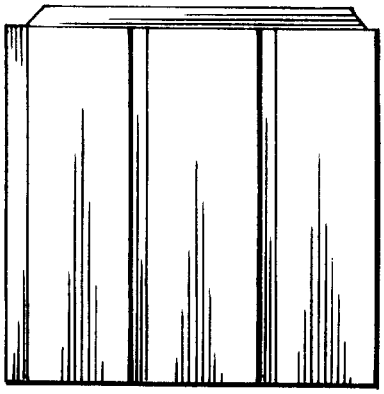
FIG. 12 is a view of one end of the block shown in FIG. 7.
Figure 13:
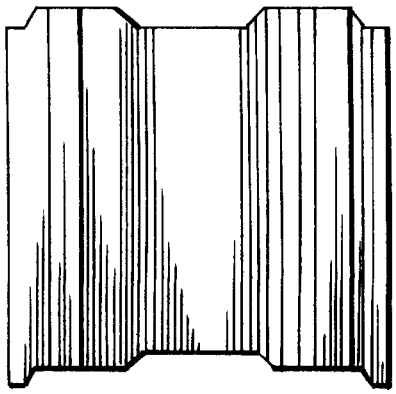
FIG. 13 is a view of the other end of the block shown in FIG. 7.

The faces 2,3 are joined together by webs 5, each of which has a broad outer ends 6 that taper inwardly to a narrower central portion 7. The thickened outer ends 6 of the webs 5 provide increased stability for the blocks during curing, while the narrower central portions of the webs advantageously permit the blocks to be lightened in weight, while providing adequate support during curing. Referring to FIGS. 5 and 6, it will also be noted that the central portion of the web is provided with a shallow channel 8 along its upper and lower surfaces. The purpose of these channels is to permit concrete that is poured into the interior of a wall constructed with the blocks of the present invention to flow between the blocks, and thereby lock adjoining blocks together securely upon curing.

As best illustrated in FIGS. 1, 5 and 6, the front and rear faces 2,3 of the blocks protrude downwardly slightly from the lower surface 9 of the webs 5. The upper surface 10 of the webs 5 and the adjoining body 11 of the block extend upwardly slightly from the faces 2,3 of the block, in a complementary shape, to permit a stretcher 1 to interlock with another stretcher along the upper and lower surfaces thereof.

Figure 2:
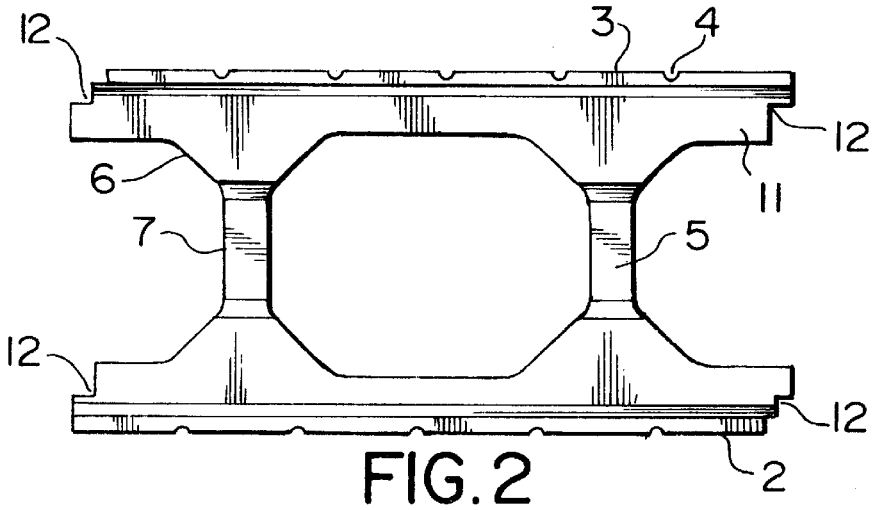
FIG. 2 is a top view of the block shown in FIG. 1.
Figure 3:
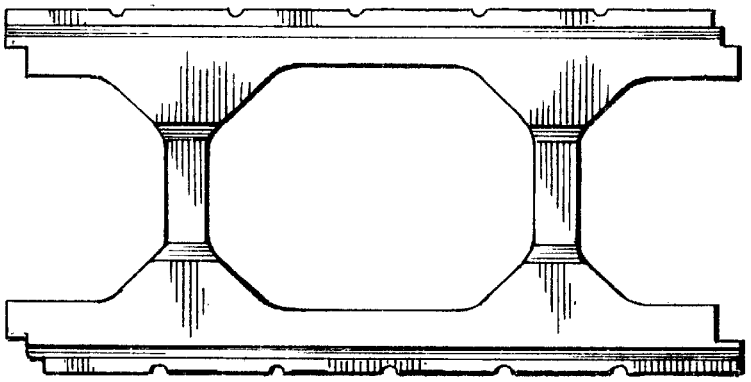
FIG. 3 is an underside view of the block shown in FIG. 1.
Figure 4:
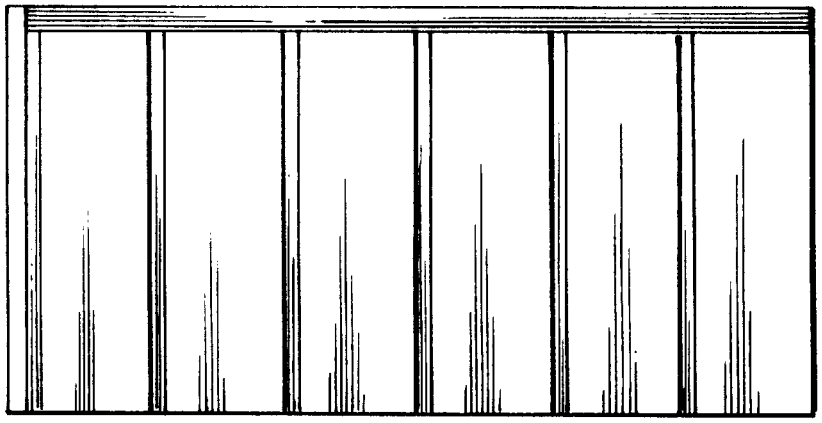
FIG. 4 is a side view of the block shown in FIG. 1.

Referring to FIGS. 1, 2 and 3, it will be seen that the ends of the stretcher block of the present invention are provided with offset square notches 12. By the term "offset" is meant that the notch 12 on one face of an end will be on the outside of the block face, while the notch on the other face of the same end will be on the inside of the block face, as can be seen in FIG. 2 or 3. By offsetting such notches 12, any two stretchers may be placed in adjoining relation, without orienting either face 2,3 of the block in a particular direction. The notches also serve to interlock the stretcher blocks with the corner blocks, as will be explained below.

Figure 14:
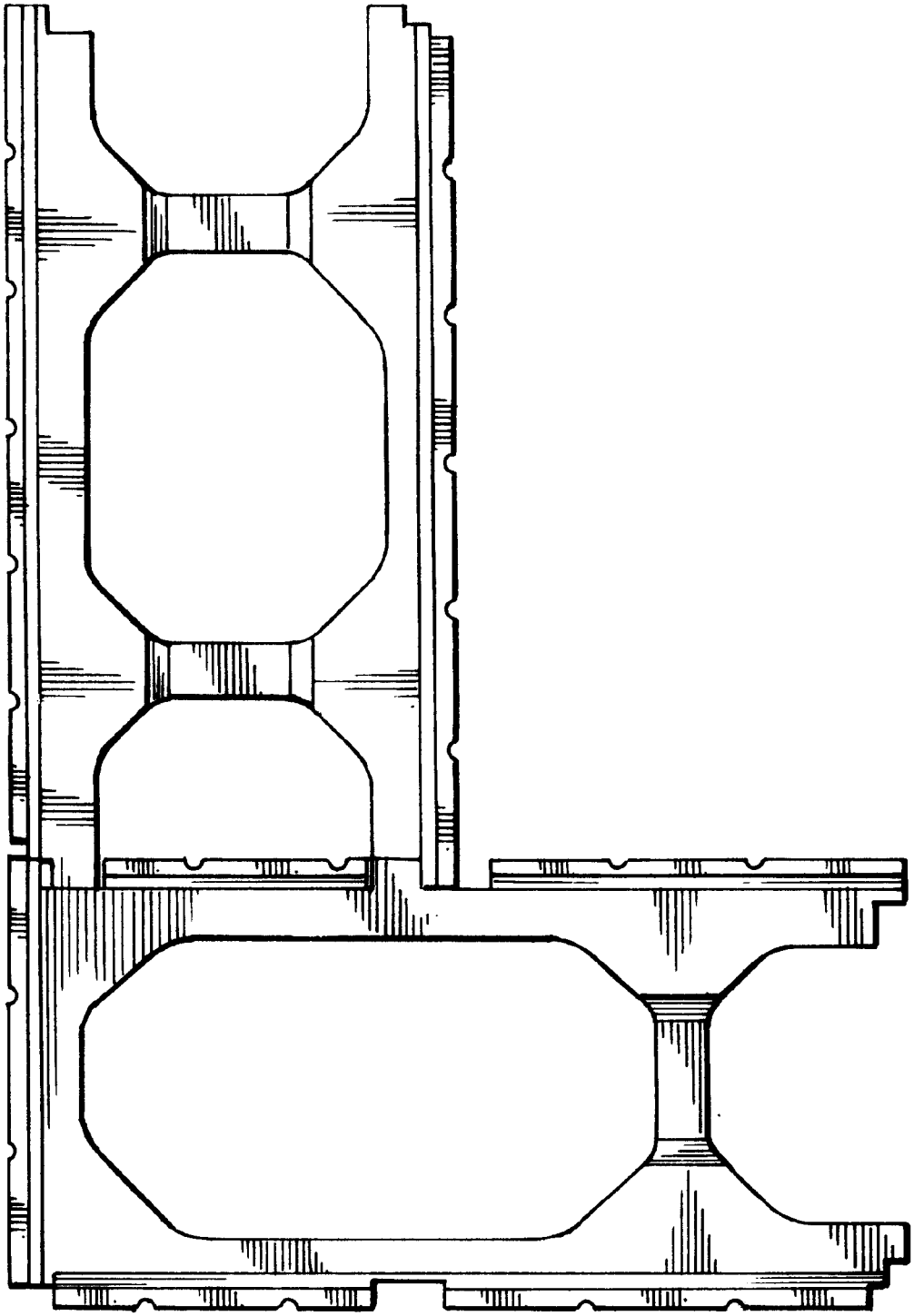
FIG. 14 is a top view of a corner constructed with a stretcher block and corner block according to the present invention.
Figure 15:
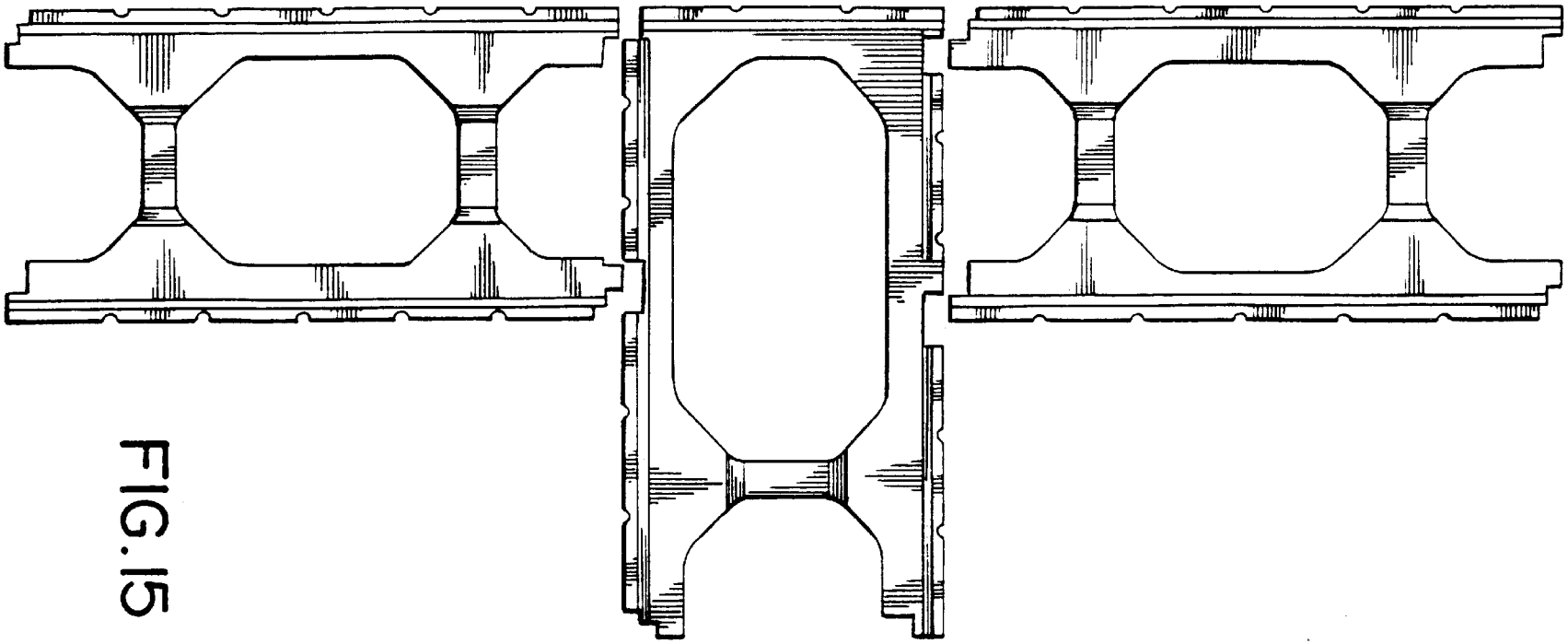
FIG. 15 is a top view of a T-intersection constructed with two stretchers and a corner block according to the present invention, with the stretchers illustrated slightly separated from the corner to better shown the joints between the stretchers and corner blocks.

With reference to FIGS. 7–13, the present invention provide a corner block 13, for use with the stretcher block of the present invention. The corner block 13 has side faces 14, 15 corresponding to the front and rear faces 2,3 of the stretcher. The side faces of the corner block are provided with grooves 4 similar to the grooves on the stretchers 1. Moreover, squared notches 16 are also formed in the side faces 14, 15 of the corner block, spaced apart so as to interfit with the notches ends of the stretchers, as can be seen in FIGS. 14 and 15. It will be noted, moreover, that the notches 16 formed in one face of the corner block are offset relative to the notches formed in the other face. This arrangement permits a stretcher 1 to be interfit with a corner block on either side of same, whereby T junctions can be formed, as shown in FIG. 15. Also, with this arrangement it is not necessary to provide a different block for right and left corners, also as illustrated in FIG. 15.

Directly beneath each notch 16, in the vertical face of the corner block is formed a notch 17, the function of which is to permit corner blocks to be stacked vertically at right angles to one another in a chimney bond pattern, to form the corner of a wall.

The ends of the corner blocks 13 are notched in a manner similar to the stretcher blocks 1, to permit interfit therewith.

The blocks of the present invention may be fabricated from any suitable concrete, as will be a matter of choice for one skilled in the art. A suitable concrete mix is as set out below:

| CONCRETE MIX DESIGN | | |
|---|---|---|
| | WEIGHTS PER CUBIC METER (SATURATED, SURFACE-DRY) | |
| SAND | 1010 KG | Source "E & E McLaughlin Agg's Ltd." |
| STONE | 1050 KG | Source "Lafarge Materials, Manitoulin" |
| PORTLAND | 154 KG | Source "St. Laurence Cement" |
| SLAG | 66 KG | Source "St. Laurence Cement" |
| AIR | 25 ml per 100/ kg of cement | |
| WR | 250 ml per 100/ kg of cement | |
| WATER | 150 Lt. | |

It is to be understood that the examples described above are not meant to limit the scope of the present invention. It is expected that numerous variants will be obvious to the person skilled in the field of concrete and masonry block design without any departure from the spirit of the invention. The appended claims, properly construed, form the only limitation upon the scope of the invention.

The embodiments of the invention in which an exclusive property or privilege is claimed are defined as follows:

1. Interfitting building blocks for wall construction, including straight stretcher blocks for constructing courses, and corner blocks, each said stretcher block comprising a building block having opposite first and second ends and comprising first and second substantiallycongruent rectangular side panels extending between said ends of said block, said panels being joined together by at least one web extending transverse to said panels, said panels each having vertical end edges at the respective first and second ends of the building block, the end edges being notched to interfit with end edges of panels of an adjacent block in a vertical joint therewith, the notches being vertically extending on the respective end edges and being disposed such that at the first end of said block, the notch of the first panel is on an inside corner and the notch on the second panel is on an outside corner, and such that at the second end of said block, the notch on the first panel is on an outside corner and the notch on the second panel is on an inside corner, each said panel including a lower edge and an outer surface; the lower edge of each panel being provided with a downwardly projecting lip substantially adjacent said outer surface, said block further having an upper side, portions of said upper side of said block being spaced inwardlyfrom said outer surface of said panels projecting upwardly, whereby one said block laid on another said block will interfit therewith each said corner block having opposed first and second ends and comprising spaced apart first and second substantially congruent rectangular side panels, each said side panel having an outer surface, an end panel joining said side panels at the first end of said corner block, and a web extending between said side panels spaced inwardly from the second end of said block, the end edges of said side panels adjacent said web being notched to interfit with the end edges of a said stretcher block in a vertical joint therewith, one said side panel being provided on its outer surfacewith a pair of vertically extending grooves spaced apart so as to interfit with the end edges of said first end of a said stretcher block, and the opposed side panel being provided on its outer surface with a pair of vertically extending grooves spaced apart so as to interfit with the end edges of the second end of one said stretcher block, whereby a T-shaped construction, with a flush outer surface, can be formed with a corner block and a pair of stretcher blocks interfit with the corner block at right angles therto, each said side panel of a said corner block having a lower edge, the lower edge of each said side panel being provided with a downwardly projecting lip substantially adjacent the outer surface, said lip of each said side panel being notched adjacent the end panel and at a point inwardly thereof corresponding to the width of one said block, said corner block also having an upperside, portions of said upper side of said corner block spaced inwardly from said outer surfaceof each said side panel projecting upwardly, to interfit with the notches in the lips of the lower edges of the side panels of another of said corner blocks when a pair of the corner blocks are laid on one another at right angles.

2. A block as claimed in claim 1, wherein said notches are squared.

3. A block as claimed in claim 1, wherein each said panel has an outer surface the outer surface of each said panel being provided with spaced vertically extending grooves therein to permit moisture to drain from the outer surface thereof.

4. A block as claimed in claim 1, wherein each said web has an upper surface and a lower surface that is provided with a shallow groove therein.

5. A block as claimed in claim 4, wherein each said web is tapered in its middle portion between said panels.

6. A block as claimed in claim 5, including two said webs, spaced apart so as to form a hollow vertical core therebetween.

7. A block as claimed in claim 6, wherein said webs are spaced apart by a distance of about half the length of a said block, with a distance of about one quarter the length of a said block between a web and the end of a block.

8. A block as claimed in claim 7, wherein all parts of a said block are integrally formed from concrete.

* * * * *